US005960962A

United States Patent [19]

Ljokkoi

[11] Patent Number: 5,960,962

[45] Date of Patent: Oct. 5, 1999

[54] SCREEN

[75] Inventor: Risto Ljokkoi, Karhula, Finland

[73] Assignee: Ahlstrom Machinery Oy, Helsinki, Finland

[21] Appl. No.: 09/135,009

[22] Filed: Aug. 17, 1998

Related U.S. Application Data

[63] Continuation of application No. PCT/FI97/00104, Feb. 18, 1997.

[30] Foreign Application Priority Data

Feb. 19, 1996 [FI] Finland ..... 960739

[51] Int. Cl.[6] ..... B07B 1/04

[52] U.S. Cl. ..... 209/273; 209/305

[58] Field of Search ..... 209/273, 278, 209/283, 305, 306

[56] References Cited

U.S. PATENT DOCUMENTS

| | | | |
|---|---|---|---|
| 4,634,521 | 1/1987 | Simola et al. | 209/17 |
| 4,684,444 | 8/1987 | Meinecke et al. | 162/380 |
| 5,236,470 | 8/1993 | Levin | 48/210 |
| 5,513,757 | 5/1996 | Papetti | 209/406 |
| 5,798,025 | 8/1998 | Iwashige | 209/305 |

FOREIGN PATENT DOCUMENTS

| | | |
|---|---|---|
| 0 487 224 | 5/1992 | European Pat. Off. . |
| 0 487 224 A1 | 5/1992 | European Pat. Off. . |
| 3240487 | 11/1982 | Germany . |
| WO 90/05807 | 5/1990 | WIPO . |
| W0 9418387 | 8/1994 | WIPO . |

*Primary Examiner*—Kenneth W. Noland
*Attorney, Agent, or Firm*—Nixon & Vanderhye P.C.

[57] ABSTRACT

A pressure screen comprises an outer housing with a pulp inlet, and accepts and rejects outlets and an advantageous mount of a stationary screen drum (screen cylinder) in the housing. The screen drum is secured at an upper end flange with bolts to an intermediate ring and supported via the intermediate ring by the housing. A rotating rotor is disposed inside the screen drum. The bottom end of the screen drum is provided with at least one groove with at least one primarily flexible material ring disposed in the groove. Cooperating substantially conical surfaces are provided in the bottom of the screen drum and a bottom intermediate ring, in which the groove is formed.

22 Claims, 5 Drawing Sheets

SCREEN

CROSS REFERENCE TO RELATED APPLICATION

This is a continuation of PCT/FI97/00104 field Feb. 18, 1997.

BACKGROUND AND SUMMARY OF THE INVENTION

The present invention relates to a pressure screen. In particular the invention relates to the structure of a pressure screen used in the wood processing industry, providing an improvement in the working reliability and safety of the device.

The pressure screens (as a general example in U.S. Pat. No. 4,634,521) used in the wood processing industry most often comprise a stationary screen drum (cylinder) within a substantially cylindrical outer housing having an inlet for suspension to be screened, and accept and reject outlets. Other inlets and outlets also may be provided, for example, plastics separated in the apparatus, and for dilution or washing liquid to be fed into the apparatus. In most cases, the apparatus is installed in an upright position so that the axis of the substantially cylindrical housing is substantially vertical. Then the top of the apparatus is easy to open or detach from the essentially cylindrical housing and the apparatus may easily be maintained. The shaft of the apparatus passes through the opposite end of the apparatus, i.e. usually the lower end, and usually rotates a rotor, although in some screens the screen cylinder itself is rotatable. Inside the cylindrical housing, there is, in addition to the rotor, also a screen or a sieve cylinder, which in most cases is cylindrical, although a number of cone-shaped screen drums are also used. Usually the screen cylinder is located outside the rotor in the radial direction. The screen cylinder is supported by the housing at both of its ends via intermediate rings. The intermediate rings are secured to the housing of the screen and the screen cylinder is secured to these intermediate rings via a securing flange at both ends.

A screen of another type is disclosed for example in U.S. Pat. No. 5,326,470 which describes many different ways of securing a screen cylinder without compressive loading. This patent discusses several ways of fastening a screen cylinder at its bottom end using a flange extending outwardly from the screen cylinder and an intermediate ring to the outer housing of the screening apparatus and at its top end by a flange extending inwardly from the screen cylinder to a centrally arranged plate sealing the top of the screen cylinder. The rotor of the screen apparatus is disposed outside of the screen cylinder.

Until recently problems had existed relating to the securement of the screen cylinder to the intermediate rings in such a way as to obtain maximum strength. Before the securing methods disclosed in U.S. Pat. No. 5,326,470 were introduced, screen cylinders were secured to intermediate rings in such a way that axial compression stress was directed to the cylinders (see for instance, FIG. 1 of DE-A1-32 40 487). If the screen cylinder was adequately robust and the application stressed the screen cylinder relatively little, no problems arose. On the other hand, as wire screen drums (i.e. wedge wire and bar screen drums) become more common the mechanical endurance of the screen cylinders became essentially weaker so that pulp and paper mills found in particular the compression stress to cause problems which were solved for example by the screen drum securing methods described in the U.S. Pat. No. 5,326,470 in which the screen cylinder is subjected to tensile stress which substantially eliminates the danger of deflection of individual screen bars. However, this patent specially discusses only instances where the rotor is positioned outside the screen cylinder.

Despite the fact that one problem in the securing of a screen cylinder was, at least partially, eliminated a number of new problems were revealed which were previously hidden behind the more serious problems discussed above. It has been found now, however, that it is very difficult to screw securing bolts on the screen cylinder tight enough that they do not come off gradually, for example as a result of screen vibration. When conventional securing methods are used, a small axial clearance is common at the upper end of the screen drum between the screen drum flange and the intermediate ring attached to the housing of the screen which is due to the many tolerances of the manufacturing technique and often even differences in tolerances of different manufacturers. In many cases, the screen drum is not delivered by the same manufacturer who originally manufactured the pressure screen. However, the clearance mentioned allows the bolt securing to "live", for example according to the temperatures or other stresses, so that the securing bolts of the drum are loosened quite easily.

A preferred embodiment of the invention provides a simple and advantageous solution to this problem. An important feature of the approach according to the invention is that there is a conical outer surface of the flange at the bottom end of the screen drum and that it is provided with at least one substantially annular groove, and that a flexible material ring is positioned in that groove.

Another drawback of the securing methods based on the tensile stress of the screen drum described in U.S. Pat. No. 5,326,470 are their complexity. In order to secure the drum in a manner that creates tensile stress, according to the embodiment of that patent illustrated in FIGS. 4 to 9 and 11, the drum must be secured by bolts at its lower end even inside the drum, which means that in practice the rotor must be detached from the pressure screen before the drum can be replaced. In the embodiments of the drawing figures of this patent, only one allows bolting the screen cylinder only at its upper end, and even then the rotor must be removed from its operation position in order to detach the screen cylinder because the inner diameter of the securing flange of the lower end of the screen cylinder is smaller than the outer diameter of the rotor. In other words, in the past utilization of a securing method providing tensile stress presupposed the use of a flange extending inside the screen cylinder which in turn meant that the rotor must be detached for the replacement or maintenance of the screen cylinder.

International patent application PCT/SE94/00013 discloses an approach in which the screen cylinder is mounted in a way so that at both ends of the screen cylinder there is a radial slot and at the slot there is a groove receiving for example an O-ring which seals the slot and at the same time supports the screen cylinder radially in place, i.e. so that the screen cylinder "floats". In the axial direction the screen drum is supported at least at one of its ends by pins extending through the drum to the body of the screen so that the drum cannot move axially or be turned. A problem is, however, that when a drum is left floating in the radial direction only supported by rubber rings, pressure pulses always vibrate the drum to some extent and even a small movement wears out both the sealing members and the pins.

An approach according to another preferred embodiment of the invention eliminates these problems. In other words, according to the invention, the pressure cylinder may be replaced without detaching the rotor, and it supports the cylinder in its place so that pressure pulses cannot move the screen cylinder.

According to one aspect of the present invention a pressure screen is provided comprising the following components: An outer housing. An inlet for material to be screened, and outlets for accepts and rejects, into and from the outer housing. A stationary screen drum disposed inside the outer housing. A rotatable rotor disposed inside the screen drum for rotation with respect thereto. The screen drum having a bottom end with a first flange, and a top end with a second flange. Bottom and top intermediate rings secured to the outer housing, the bottom intermediate ring having an inner edge with a substantially conical surface opening toward the top ring. The second flange connected to the top intermediate ring. The first flange having an outer substantially conical downwardly tapering surface having at least one substantially annular groove with at least one primarily flexible material ring therein. And the first flange outer surface supported by the bottom ring substantially conical surface.

The primarily flexible material ring may be affixed to the bottom intermediate ring substantially conical surface. The second flange may be connected to the top intermediate ring by a plurality of pin bolts cooperating with nuts having a substantially hexagonal shape; and the assembly may further comprise a structure extending above the top intermediate ring which engages the side surfaces of substantially all of the nuts to prevent the nuts and pin bolts from unscrewing. The primarily flexible material ring may include a rigid material stiffening element therein.

According to another aspect of the present invention a pressure screen is provided comprising the following components: An outer housing. An inlet for material to be screened, and outlets for accepts and rejects, into and from the outer housing. A stationary screen drum disposed inside the outer housing. A rotatable rotor disposed inside the screen drum for rotation with respect thereto. The screen drum having a bottom end, and a top end with a flange. Bottom and top intermediate rings secured to the outer housing. The flange connected to the top intermediate ring, and the screen drum bottom end supported by the bottom intermediate ring. And the bottom intermediate ring comprising a substantially conical inner edge surface having at least one annular groove with at least one primarily flexible material ring therein.

In the pressure screen described above, the at least one primarily flexible material ring may include one or more bands or rings of a relatively rigid stiffening material, such as steel bands. The screen drum is preferably a wire drum (that is a wedge wire or a bar screen drum).

According to another aspect of the present invention, a stationary screen drum (for example a wire drum) for use in a pressure screen is provided comprising the following components: A screen drum body having a screening surface, a top end, and a bottom end. A flange provided on the bottom end, the flange having an outer substantially conical surface having a downward taper. And at least one substantially annular groove provided in the flange outer substantially conical surface. At least one substantially annular ring of primarily flexible material may be disposed in said substantially annular groove.

According to still another aspect of the present invention there is provided a method of replacing or maintaining a stationary screen drum within a pressure screen housing including an inlet for material to be screened, outlets for accepts and rejects, and a rotor disposed within and distinct from the screen drum and rotatable about a substantially vertical axis. The method comprises: (a) mounting a screen drum devoid of a bottom interior mounting flange within the outer housing so that the screen drum is subjected primarily to tensile stress, and is not subjected to axial compression stress that adversely affects operation thereof; and (b) when necessary or desired, accessing the screen drum to effect replacement or maintenance thereof without detaching the rotor. The method wherein (a) and (b) are practiced may utilize a wire screen drum as the screen drum. In the method (a) may be practiced utilizing cooperating substantially conical surfaces on the screen drum and on an attachment to the pressure screen housing, at least one of the surfaces having at least one substantially annular groove therein; and providing at least one primarily flexible material ring in the substantially annular groove.

It is the primary object of the present invention to effectively mount a pressure screen drum within a pressure screen housing so that it is not subjected to axial compression stress that adversely affects operation thereof, yet allows ready replacement or maintenance of the screen drum without having to detach the rotor of the pressure screen in which the screen drum is provided. This and other objects of the invention will become clear from an inspection of the detailed description of the invention and from the appended claims.

DETAILED DESCRIPTION OF THE DRAWINGS

Figure 1:
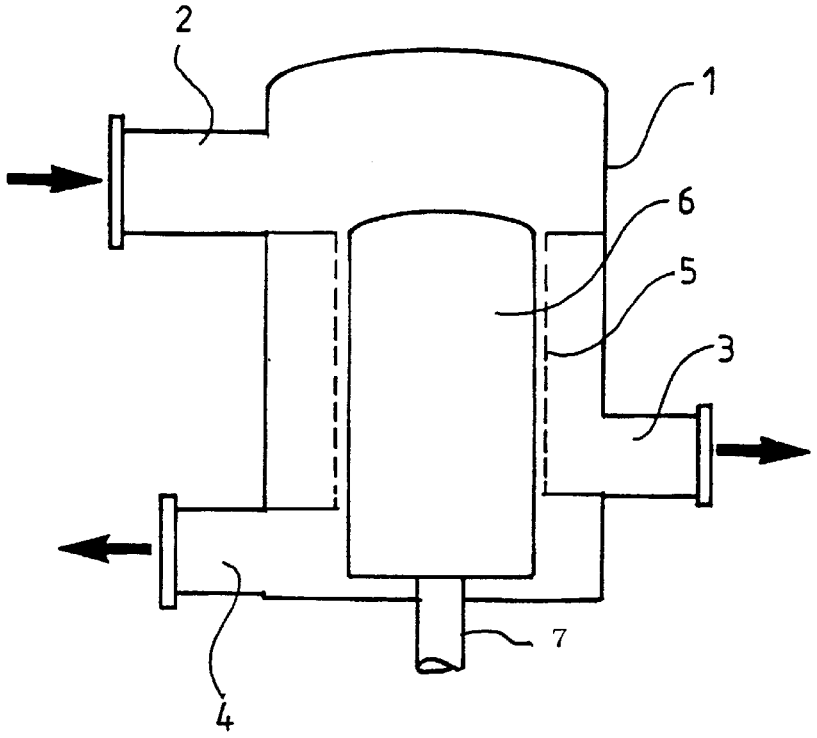
FIG. 1 (PRIOR ART)
FIG. 1 is a schematic side view of a conventional pressure screen used in the wood processing industry.

As illustrated in FIG. 1, a pressure screen is provided comprising an outer housing 1, an inlet 2 for the pulp 2 fed into housing 1, an accepts outlet 3, and a rejects outlet 4. Inside the outer housing 1, there is a screen or sieve surface defined by a stationary screen drum (cylinder) 5 having a screen surface between top and bottom ends. Interiorly of the screen drum 5 is a rotor 6, rotatable about an axis defined by shaft 7 with respect to the screen drum 5.

Figure 2A:
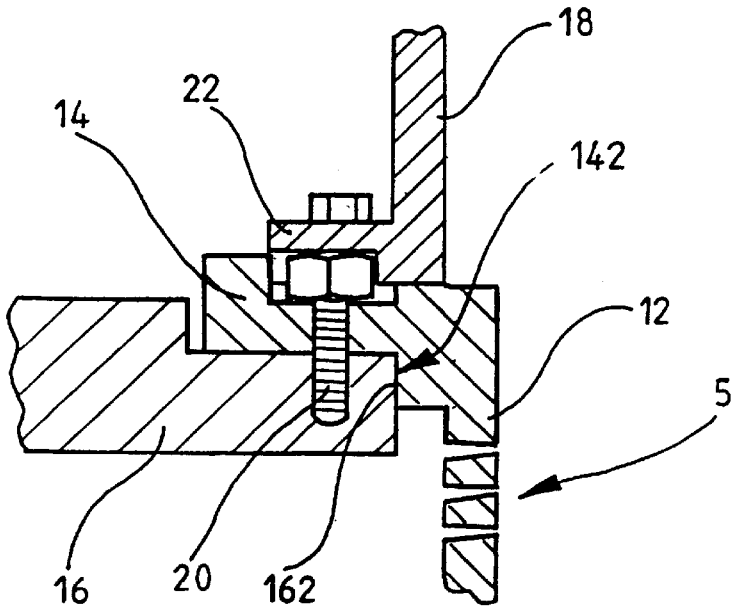
FIG. 2*a* is a side primarily cross-sectional detail view, and FIG. 2*b* a top detail view, of apparatus mounting a screen drum in the pressure screen of FIG. 1, according to a preferred embodiment of the invention.
Figure 2C:
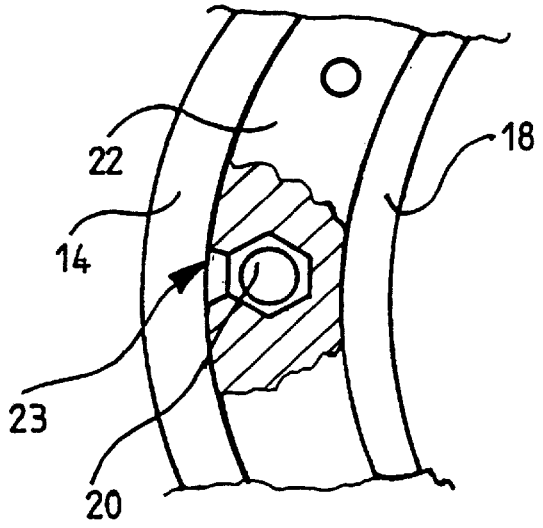
FIG. 2*c* is a view like that of FIG. 2*b* for another embodiment.
Figure 2B:
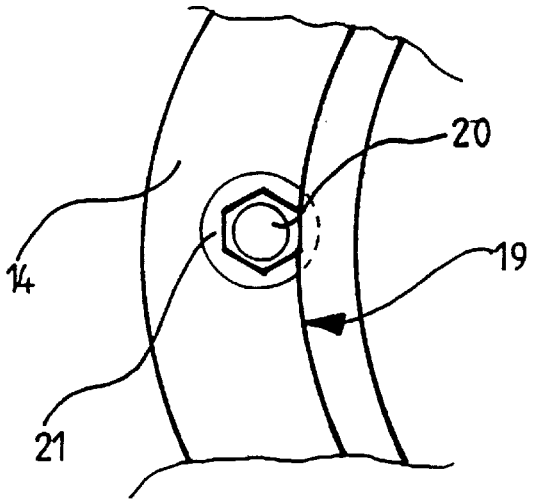

FIGS. 2*a* and 2*b* illustrate in detail how a screen drum 5 is reliably secured in place according to a preferred embodiment of the invention. FIGS. 2*a* and 2*b* illustrate only the top end 12 of the screen drum 5, its securing flange 14, an intermediate ring 16 operatively secured to the housing 1, an impurity separator 18, and one of the plurality of securing bolts 20 for securing the screen drum 5. As may be seen in FIGS. 2*a* and 2*b*, the intermediate ring 16 includes (in this embodiment) a substantially annular surface 162 substantially parallel to the axis of the screen drum 5 against which the guiding surface 142 of the securing flange 14 of the screen drum 5 is tightly set. Guided by the two surfaces 162, 142, the screen drum 5 is positioned centrally around the axis of the pressure screen, defined by the shaft 7. Thus, the holes in the securing flange 14 for the securing bolts 20 are a little loose so as to allow axial guiding of the screen drum 5 to take place via only the surfaces 142, 162.

As also illustrated in FIGS. 2*a* and 2*b*, the screen drum 5 has been secured to the intermediate ring 16 through its flange 14 by way of the bolts 20. In prior art apparatus, the same bolts 20 were used to also secure the conventional impurity separator, like separator 18, which is an essentially cylindrical ring extending above the screen drum 5 and which prevents very coarse impurities, such as stones, tramp metal, and other such pieces of hard material, from entering the screening zone between the screen drum 5 and the rotor 6 (see FIG. 1). FIG. 2*b* shows that the securing flange 14 of the screen drum 5 has an annular guide surface 19 for the impurity separator 18 for centering the impurity separator 18 centrally around the axis of the screen. FIG. 2*b* also illustrates the securing flange 14 having a cylindrical recess 21 which partly opens to the cylindrical guide surface 19. Thus, when the screen drum 5 is secured with the bolts 20 to the intermediate ring 16, one of the sides of the hexagonal head of the bolt 20 substantially aligns with the guide surface 19 and is substantially parallel to its tangent so that when the impurity separator 18 is installed in its place against the guide surface 19 it locks each securing bolt 20 of screen drum 5 securely in place.

In a corresponding way the guide surface of the impurity separator 18 may be positioned outside the periphery of the screen drum 5 securing bolts 20, thus obtaining a corresponding locking of the bolts 20.

Further, in the embodiment illustrated in FIG. 2*c*, the lower part of an impurity separator 18, either the securing flange 22 of the impurity separator 18, or the lower part of the cylindrical piece itself, has been shaped so that it prevents the securing bolts 20 of the screen drum 5 from unscrewing. In other words, in the securing flange 22, or at the lower end of the cylindrical piece, there is a recess 23 which at least partly adapts to the form of the end of the securing bolt 20 and which locks the end of the securing bolt 20 stationarily (that is, so that it is not turnable) in place.

If the pressure screen does not include an impurity separator 18, the separator 18 may be replaced by a plain ring, which is placed by the side of or on top of the circular layout of the bolts 20 securing the screen drum 5, depending on which of the embodiments, i.e. securing methods, described above is chosen, and locks all the bolts 20 either in the manner illustrated in FIGS. 2*b* and 2*c*, or in some other way. It would be advantageous in most cases to be able to lock all the bolts 20 with one single structure, for example by using an impurity separator 18 or a particular ring, but it is possible also to provide several locking structures each of which locks several bolts 20 at a time. Preferably these structures form an annular ring on top of or by the side of the bolt circular layout, but the invention covers also other applications in which several bolts 20 are locked in place at a time. The impurity separator 18 itself, or the ring replacing it, is secured in place by separate securing bolts, e.g. as shown schematically at 15 in FIG. 2*a*. Thus, although the total number of securing bolts used increases the load directed to the securing bolts 15 of the impurity separator 18 or the ring is negligible compared to the securing bolts 20 of the screen drum 5, and thus the tendency of these bolts to unscrew is also remarkably smaller.

Figure 3:
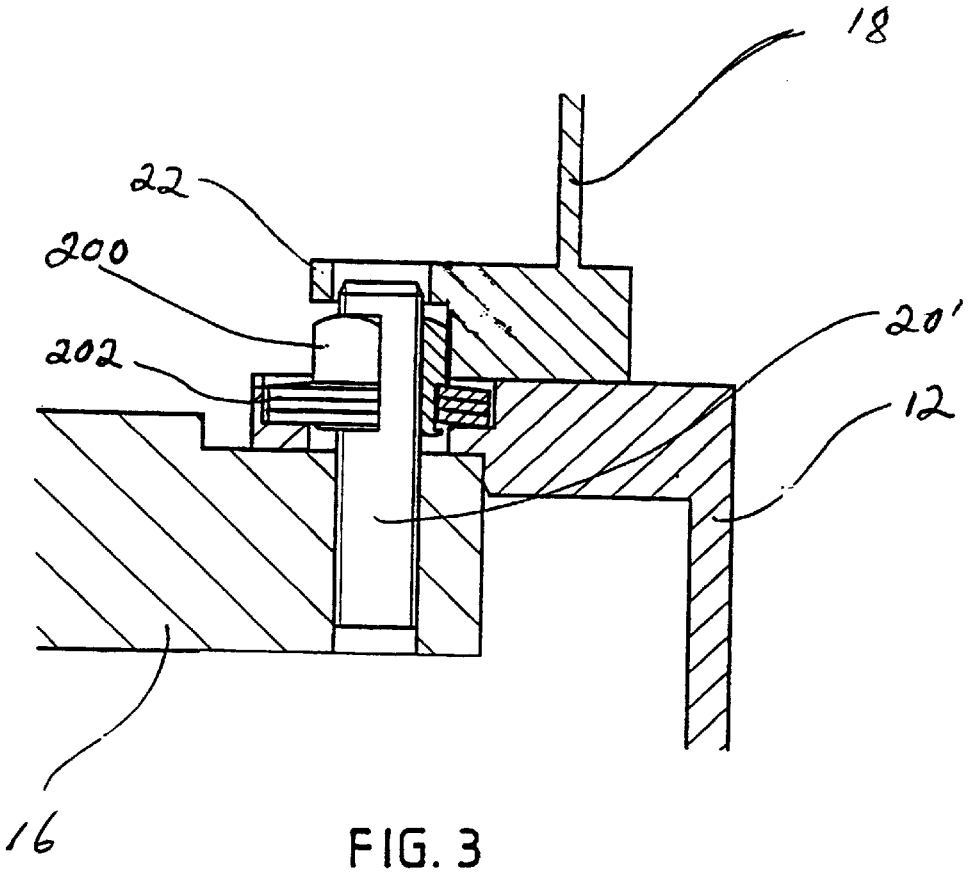
FIG. 3 is a view like that of FIG. 2*a* for another embodiment.

FIG. 3 illustrates an alternative to the embodiment of FIG. 2*a* in which the bolt 20 of FIG. 2*a* has been replaced by a pin bolt 20', and the structure to be locked in the embodiment of FIG. 3 is a nut 200 which corresponds to the head of the bolt 20 in FIG. 2*a*. This means that the nut 200 may be locked in place by the impurity separator 18 or a corresponding structure as described above. FIG. 3 further illustrates a preferred, but not indispensable, additional alternative in which spring washers 202 have been provided operatively engaging the nut 200 and press the securing flange 14 against the intermediate ring 16 of the pressure screen.

Further, it is possible that the bolt 20' may be, instead of a pin bolt, an ordinary bolt (not shown) with a head which has been screwed down through the intermediate ring 16 so that the end of the ordinary bolt extends above the surface of the intermediate ring 16 like the end of the pin bolt 20'. In this case securement is carried out just as illustrated in FIG. 3. An advantage provided by this manner of securement is that if the ordinary bolt has for some reason broken off on the nut (200) side the bolt 20' may still be screwed out of the hole in a conventional way after the screen drum 5 has been removed. During the first assembly, the head of the ordinary bolt may be secured in its place for example by two welding spots so that the ordinary bolt cannot, if snapped, unscrew and end up in the accepts outlet 3. Such a welding spot is easy to grind off when the ordinary bolt is replaced by a new one.

Figure 4:
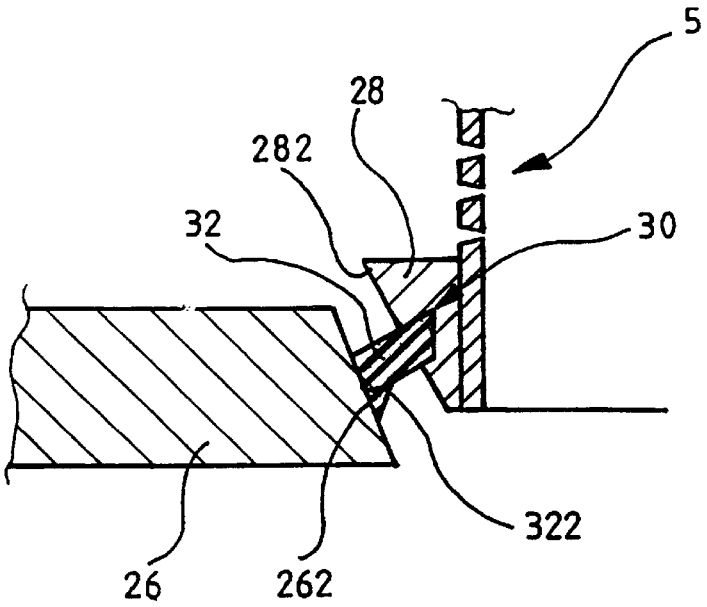
FIG. 4 is a side detail, cross-sectional, view of a screen drum mount according to another preferred embodiment of the invention.

FIG. 4 illustrates a mechanism according to a preferred embodiment for the invention for supporting the screen drum 5 in place without directing practically any compression stress at all to the screen drum 5. As already stated, previously there were two ways of securing a screen drum 5. The first way was to secure the screen drum 5 with bolts at its top end, only, and to press the conical bottom end of the screen drum against the surface of the conical intermediate ring as shown in DE-A1-32 40 487. In other words, the screen drum 5 was set centrally in its place by utilizing compression stress and thus it was easy to remove without having to detach the rotor 6 located inside it. The other way, which is described in U.S. Pat. No. 5,326,470, avoids the undesirable compression stress of the first way but has the drawback of having to dismount the rotor before the screen drum can be detached and removed.

FIG. 4 shows how an intermediate ring 26 connected to the housing 1 of the pressure screen may be provided with a substantially conical surface 262 opening upwardly. The angle of surface 266 is on the order of about 5–5°, preferably about 10–20°, and appropriately about 15 degrees. In a corresponding way the flange 28 of the lower end of the screen drum 5 has been provided with a substantially conical surface 282 tapering downwardly. A substantially annular groove 30 is provided in the substantially conical surface 282 of the screen drum 5 flange 28, substantially at the center region thereof, the depth of the groove 30 in most of the embodiments presented herein preferably on the order of about 3–10 mm and its width preferably on the order of about 5–15 mm depending upon the dimensions of the ring/rings used. The groove 30 is preferably provided with at least one ring 32 made of rubber of some other corresponding primarily flexible (e.g. elastomeric) material and preferably affixed therein (e.g. with adhesive). The cross section of the ring 32 is preferably such that its preferably substantially conical surface 322, placed against the conical surface 262 of the intermediate ring 26, is relatively broad thus ensuring good sealing between the surfaces 262 and 322.

The dimensions of the substantially conical surfaces 262, 282 and 322 and the ring 32 have been chosen so as to have as little axial compression stress of the screen drum 5 as possible and to provide a guiding action which centers the screen drum 5 lower end in the radial direction as well as possible.

Figure 5A:
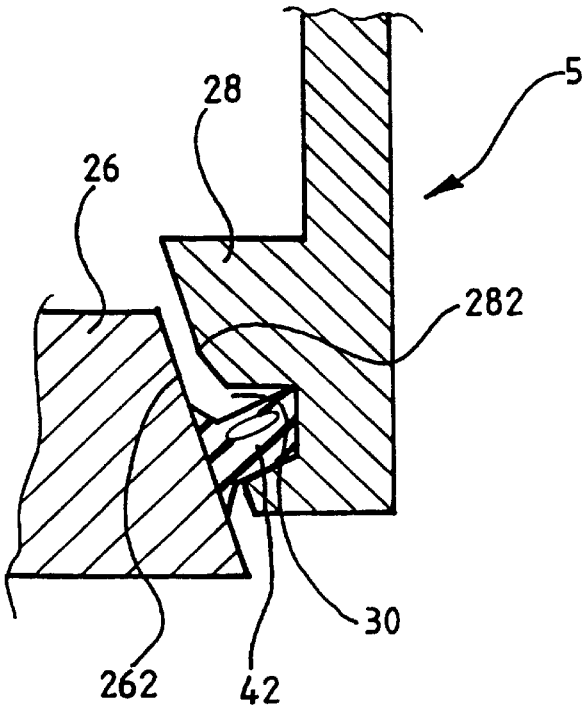
FIGS. 5*a* and 5*b* are views like that of FIG. 4 of another preferred embodiment of the invention.
Figure 5B:
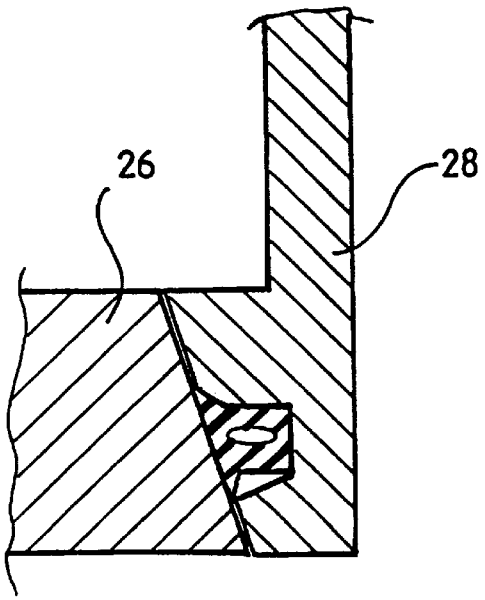

FIGS. 5*a* and 5*b* illustrate a structure for guiding the lower end of the screen drum according to another preferred embodiment of the invention. This embodiment is similar to the embodiment of FIG. 4. The only major difference is that the flexible ring 42 has been affixed (e.g. with adhesive) in this embodiment to the substantially conical surface 262 of the intermediate ring 26 in turn affixed to the housing 1 of the pressure screen. The purpose is to cause the flexible ring 42 to be bent, when the screen drum 5 is pushed into place, into the groove 30 provided in the substantially conical surface 282 of the screen drum 5 lower end flange 28, i.e. into the position illustrated in FIG. 5*b*, and both to efficiently seal the space between the conical surfaces 262 and 282, and to center the screen drum 5 exactly in the substantially correct position.

Figure 6:
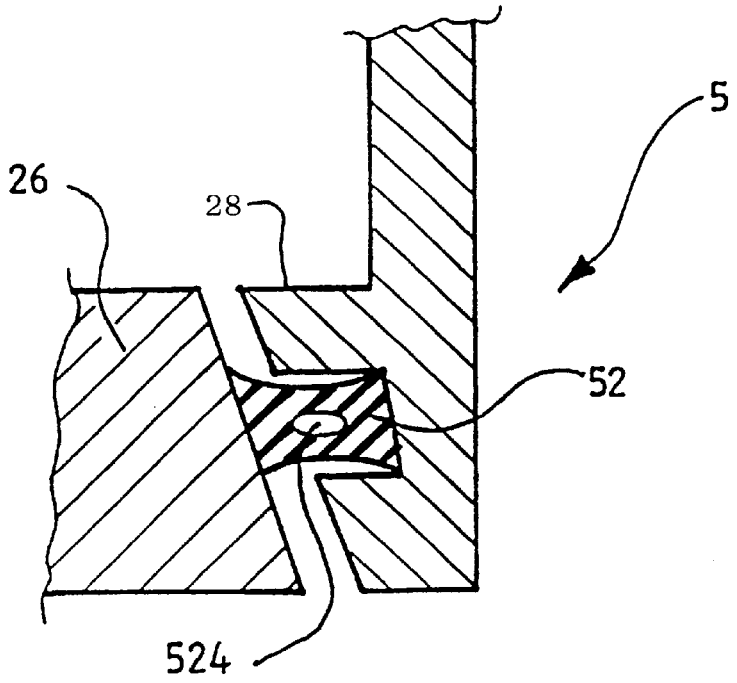
FIGS. 6 through 8 are views like that of FIG. 5*a* of still other embodiments according to the invention.

FIG. 6 illustrates a structure for guiding the lower end of the screen drum 5 according to a third preferred embodiment of the invention. In this embodiment the flexible material ring 52 is a ring which is primarily made of elastomeric material (for example rubber) but has a substantially rigid material (e.g. metal) ring 524 disposed in the middle of it, which remarkably stiffens the structure of the ring 52. This kind of ring 52 need not necessarily be affixed in the cooperating surfaces of the structures 26, 28 but rather the ring 52 stays in its place simply by the action of the metal ring 524.

Figure 7:
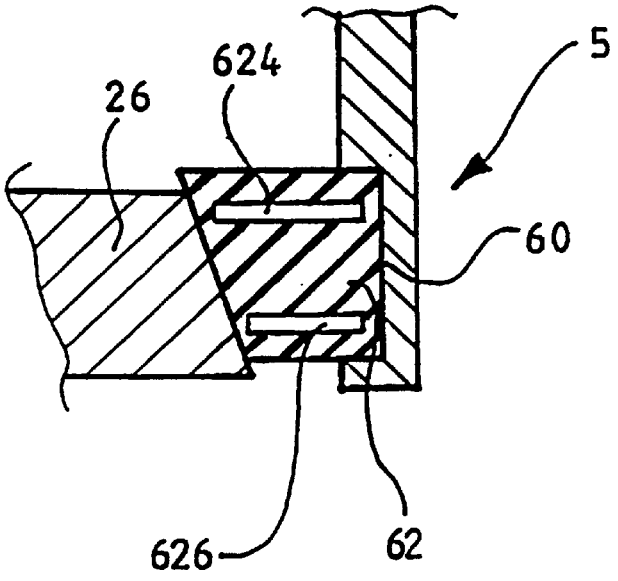

FIG. 7 illustrates a structure for guiding the lower end of a screen drum 5 according to a fourth preferred embodiment of the invention. In this embodiment, a flexible ring 62 replaces the flange (28) of the lower end of the screen drum 5. Preferably the flexible ring 62 is placed in a substantially annular groove (60) machined in the screen drum 5 outer surface. In this embodiment it is advantageous to have two annular relatively rigid material bands 624 and 626 (for example steel bands) disposed inside the flexible ring 62 as illustrated in FIG. 7. The function of the bands 624 and 626 is to stiffen the ring 62 particularly in the radial direction so that the ring 62, firstly, stays firmly in the groove 60 and, secondly, supports the screen drum 5 in place centrally as well as possible.

Figure 8:
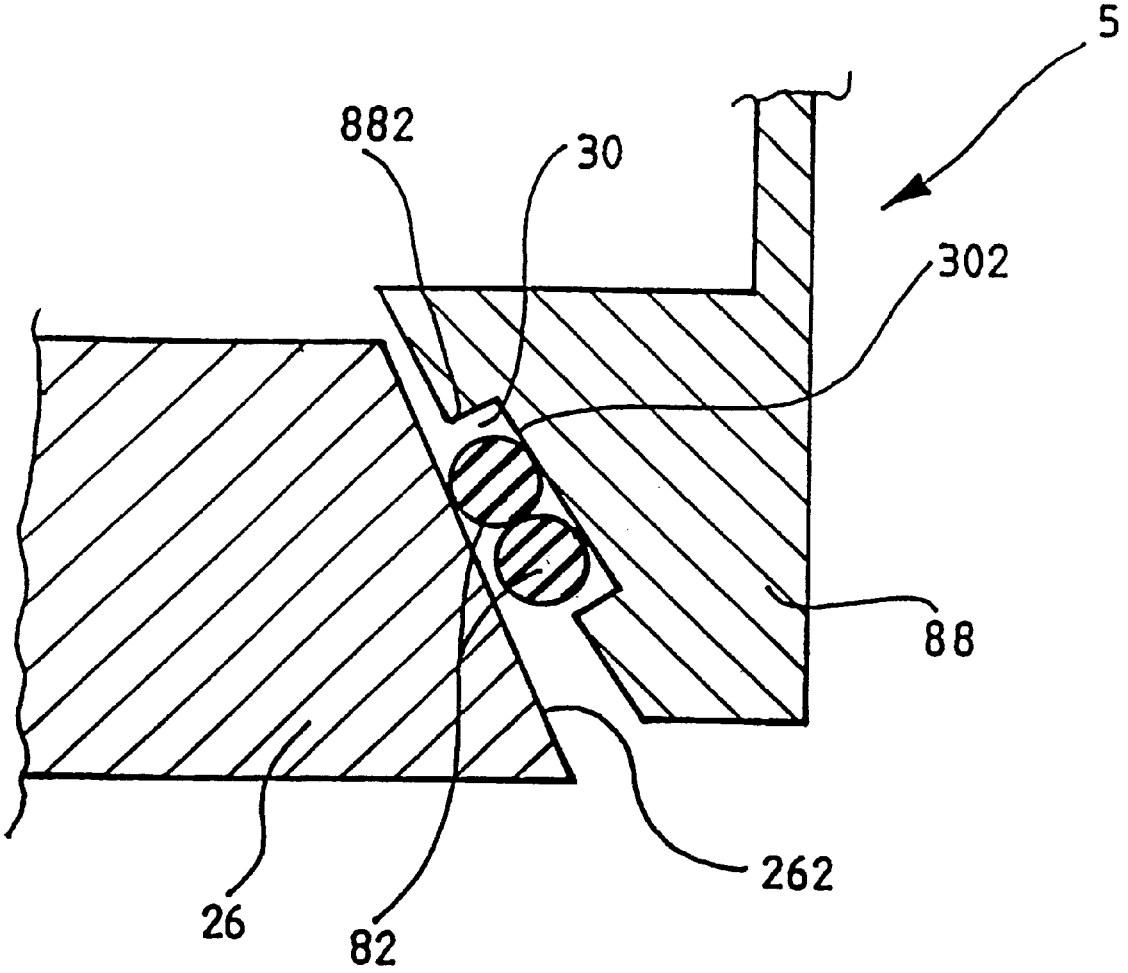

FIG. 8 illustrates a structure for guiding the lower end of a screen drum 5 according to still another preferred embodiment of the invention. In this embodiment, a substantially annular groove 30 having a bottom surface 302 is provided in the conical surface 882 of a ring 88 at the lower end of the screen drum 5. The bottom surface 302 is substantially conical. The surface 302 is preferably not parallel to the conical surface 882 but rather tapers downwardly at a greater angle. The substantially conical surface 882 in turn preferably tapers downwardly at a slightly greater angle than the substantially conical surface 262 of the intermediate ring 26, although these surface may be parallel. The groove 30 is provided with at least one O-ring 82, preferably two O-rings, preferably of rubber, so that when the screen drum is pushed downwardly the ring/rings 82 roll upwardly along the bottom surface 302 of the groove 30 so that they are wedged between the bottom surface 302 of the groove and the conical surface 262 of the intermediate ring 26, and both seal the lower end of the screen drum 5 and substantially exactly center the drum 5.

An advantage provided by the conical forms, in which the cone angle of the conical surface 262 of the intermediate ring 26 is smaller than the cone angle of the lower end 28 of the screen drum 5 or the cone angle of the bottom of the groove provided at the lower end, illustrated in most of the embodiments of FIGS. 2–8 that there is a wedge-like space tapering towards the accepts space provided between the cooperating surfaces. Considering the pressurized environment inside the pressure screen, i.e. the fact that the pressure is the highest inside the screen drum 5 and the lowest in the accepts space, the pressure inside the screen 5 drum presses the cooperating components between the conical surfaces mentioned towards the more tapered end of the wedge-like space and thus the sealing ability of the assembly improves. In other words, it is typical of a preferred embodiment of the invention that the sealing and support of the lower end of the screen drum 5 is provided by two substantially conical members so that a space is provided between the two surfaces which space tapers in a wedge-like fashion towards the lower pressure, and a member (e.g. sealing ring) sealing and supporting the lower end of the screen drum is provided in this space.

While it is preferred that a single substantially annular groove, and either one or two primarily flexible material rings associated with that groove, be provided, more than one groove, and a plurality of rings within each or several of the grooves, may be provided. Other modifications are also possible within the scope of the invention, which scope is to be accorded the broadest interpretation of the appended claims so as to encompass all equivalent structures and methods.

What is claimed is:

1. A pressure screen comprising:

an outer housing;

an inlet for material to be screened, and outlets for accepts and rejects, into and from said outer housing;

a stationary screen drum disposed inside said outer housing;

a rotatable rotor disposed inside said screen drum for rotation with respect thereto;

said screen drum having a bottom end with a first flange, and a top end with a second flange;

bottom and top intermediate rings secured to said outer housing, said bottom intermediate ring having an inner edge with a substantially conical surface opening toward said top ring;

said second flange connected to said top intermediate ring;

said first flange having an outer substantially conical downwardly tapering surface having at least one substantially annular groove with at least one primarily flexible material ring therein; and said first flange outer surface supported by said bottom ring substantially conical surface.

2. A pressure screen as recited in claim 1 wherein said primarily flexible material ring is affixed to said bottom intermediate ring substantially conical surface.

3. A pressure screen as recited in claim 1 wherein said substantially annular groove has a substantially conical bottom surface.

4. A pressure screen as recited in claim 3 wherein said bottom intermediate ring substantially conical surface has a first cone angle, and wherein said substantially conical bottom surface of said substantially annular groove has a second cone angle, and wherein said cone angle is larger than said first cone angle.

5. A pressure screen as recited in claim 1 wherein said second flange is connected to said top intermediate ring with a plurality of hexagonal head bolts; and further comprising a structure mounted atop said intermediate ring engaging a side surface of substantially each of said hexagonal bolt heads so as to substantially prevent unscrewing of said bolts.

6. A pressure screen as recited in claim 5 wherein said structure engaging said hexagonal bolt heads comprises an impurity separator.

7. A pressure screen as recited in claim 5 wherein said structure for engaging said hexagonal bolt heads has a plurality of recesses formed therein which substantially conform to said bolt heads, said bolt heads engaging said structure at said recesses.

8. A pressure screen as recited in claim 6 wherein said bolts comprise a first plurality of bolts; and further comprising a second plurality of bolts, distinct from said first plurality of bolts, for attaching said impurity separator to said screen drum.

9. A pressure screen as recited in claim 1 wherein said second flange is connected to said top intermediate ring by a plurality of pin bolts cooperating with nuts having a substantially hexagonal shape; and further comprising a structure extending above said top intermediate ring which engages the side surfaces of substantially all of said nuts to substantially prevent said nuts and pin bolts from unscrewing.

10. A pressure screen as recited in claim 9 wherein said structure engaging said hexagonal bolt heads comprises an impurity separator; and wherein said bolts comprise a first plurality of bolts; and further comprising a second plurality of bolts, distinct from said first plurality of bolts, for attaching said impurity separator to said screen drum.

11. A pressure screen as recited in claim 1 wherein said primarily flexible material ring includes at least one rigid material stiffening element therein.

12. A pressure screen as recited in claim 1 wherein said screen drum comprises a wire screen drum.

13. A pressure screen comprising:

an outer housing;

an inlet for material to be screened, and outlets for accepts and rejects, into and from said outer housing;

a stationary screen drum disposed inside said outer housing;

a rotatable rotor disposed inside said screen drum for rotation with respect thereto;

said screen drum having a bottom end, and a top end with a flange;

bottom and top intermediate rings secured to said outer housing;

said flange connected to said top intermediate ring, and said screen drum bottom end supported by said bottom intermediate ring; and said bottom intermediate ring comprising a substantially conical inner edge surface having at least one annular groove with at least one primarily flexible material ring therein.

14. A pressure screen as recited in claim 13 wherein said primarily flexible material ring includes at least one rigid material stiffening element therein.

15. A pressure screen as recited in claim 13 wherein said primarily flexible material ring is disposed directly between said screen drum and said substantially conical inner edge surface of said bottom intermediate ring without a flange at said lower end of said screen drum.

16. A pressure screen as recited in claim 13 wherein said screen drum comprises a wire screen drum.

17. A stationary screen drum for use in a pressure screen, comprising:

a screen drum body having a screening surface, a top end, and a bottom end;

a flange provided on said bottom end, said flange having an outer substantially conical surface having a downward taper; and at least one substantially annular groove provided in said flange outer substantially conical surface.

18. A stationary screen drum as recited in claim 17 wherein said screen drum body comprises a wire screen drum body.

19. A stationary screen drum as recited in claim 17 further comprising at least one primarily flexible material ring disposed in said substantially annular groove.

20. A method of replacing or maintaining a stationary screen drum within a pressure screen housing including an inlet for material to be screened, outlets for accepts and rejects, and a rotor disposed within and distinct from the screen drum and rotatable about a substantially vertical axis, said method comprising:

(a) mounting a screen drum devoid of a bottom interior mounting flange within the outer housing so that the screen drum is subjected primarily to tensile stress, and is not subjected to axial compression stress that adversely affects operation thereof; and (b) when necessary or desired, accessing the screen drum to effect replacement or maintenance thereof without detaching the rotor; and wherein (a) is practiced utilizing cooperating substantially conical surfaces on the screen drum and on an attachment to the pressure screen housing, at least one of the surfaces having at least one substantially annular groove therein; and providing at least one primarily flexible material ring in the substantially annular groove.

21. A method as recited in claim 20 wherein (a) and (b) are practiced utilizing a wire screen drum.

22. A method as recited in claim 20 wherein (a) is further practiced by providing at least one rigid material stiffening element in said at least one primarily flexible material ring.

* * * * *